United States Patent [19]

Jurt

[11] Patent Number: 4,466,150

[45] Date of Patent: Aug. 21, 1984

[54] TOOTHBRUSH

[75] Inventor: Alfred Jurt, Triengen, Switzerland

[73] Assignee: Trisa Bürstenfabrik AG, Triengen, Switzerland

[21] Appl. No.: 432,433

[22] Filed: Oct. 4, 1982

[30] Foreign Application Priority Data

Oct. 15, 1981 [DE] Fed. Rep. of Germany ..... 3140903

[51] Int. Cl.[3] ..... A46B 9/04

[52] U.S. Cl. ..... 15/143 R; 15/167 R; 40/314; 116/308

[58] Field of Search ..... 15/167 R, 167 A, 143 R; 40/314, 315, 331; 116/308, 309

[56] References Cited

U.S. PATENT DOCUMENTS

| | | | |
|---|---|---|---|
| 427,254 | 5/1890 | Danielowsky | 116/308 X |
| 1,370,956 | 3/1921 | Fish | 116/308 |
| 1,582,589 | 4/1926 | Exline | 40/314 |
| 2,471,680 | 5/1949 | Gibson, Jr. | 15/143 R |
| 2,489,707 | 11/1949 | Eubanks | 40/314 X |

FOREIGN PATENT DOCUMENTS

| | | | |
|---|---|---|---|
| 2405403 | 8/1975 | Fed. Rep. of Germany | 15/143 R |

*Primary Examiner*—Peter Feldman

*Attorney, Agent, or Firm*—Werner W. Kleeman

[57] ABSTRACT

At the handle of a bristle carrier or support of a toothbrush there is rotatably mounted disk-shaped indicator element. This indicator element contains a scale-like indicia or markings composed of data symbols, especially date symbols, which are distributed at an essentially equidistant spacing from one another about the circumference of the indicator element. Each data marking designates the month of a year. At the bristle carrier or support there is applied a second marking or indicia in the form of a mark which is located opposite the markings or indicia provided at the indicator element. By rotating the indicator element it is possible to align that data mark of the markings of the indicator element with the marker at the bristle carrier which is representative of the date when the toothbrush has started to be used or the contemplated date for possibly replacing such toothbrush. The indicator element can be subsequently arrested in its selected or set date indicating position.

36 Claims, 11 Drawing Figures

TOOTHBRUSH

BACKGROUND OF THE INVENTION

The present invention relates to a new and improved construction of a toothbrush.

Generally speaking, the toothbrush of the present development is of the type containing a bristle support or carrier in which there are retained the bristles of the toothbrush. There also is provided a date-indicating arrangement possessing first indicia or markings representative of a number of mutually different, especially equal length time intervals.

It is well known that it is recommendable to replace a toothbrush, for hygienic reasons, after it has been in use a certain amount of time, preferably after three months following the initial use thereof. Very few users are capable of recalling the exact date that they started using their toothbrush, and most users do not keep any record of this event. Thus, as a general rule, the user of the toothbrush is incapable of reconstructing the duration of use of his or her toothbrush. Therefore, in most instances the toothbrush is used for too long a period of time.

In German Patent Publication No. 2,405,403 there is disclosed to the art a toothbrush containing a date-indicating arrangement which allows fixing the exact date of purchase of the toothbrush or the date that it is first placed into use. For this purpose there are provided at the handle of the toothbrush twelve point-like perforatable marking locations arranged along a straight line. By means of a pin it is possible to punch-out the corresponding marking location representative of the month of purchase of the toothbrush or when it was first placed into use, as the case may be, so that the toothbrush user can determine at any point in time the age of his or her toothbrush.

This state-of-the-art solution is afflicted with the drawback that for punching-out the markings or marking locations there must be available a suitable instrument. If there is incorporated into the purchased package containing the toothbrush, for instance, a pin member for punching-out the relevant month's date, then the package for receiving this pin member must be appropriately designed. Moreover, during the course of the packaging operation there is required an additional step for the insertion of the pin member or the like into the package containing the toothbrush. But also applying the date is relatively tedious and cumbersome, particularly since the punching-through of the correct place at the twelve point-like marking locations requires a certain amount of dexterity. If inadvertently the wrong location is perforated then it is not readily possible to correct the false date indication which has been punched-out.

SUMMARY OF THE INVENTION

Therefore, with the foregoing in mind it is a primary object of the present invention to provide a new and improved construction of toothbrush which is not afflicted with the aforementioned drawbacks and shortcomings of the prior art proposals.

Another and more specific object of the present invention is directed to a new and improved toothbrush of the previously mentioned type, which is relatively simple in construction and design, possesses as few parts as possible, is economical to fabricate, and it is possible for the user, without any great difficulty or expenditure in time, to reliably set data at the toothbrush which is indicative of the correct date that the user has begun using the toothbrush or, as desired, the point in time when his or her toothbrush should be replaced.

Now in order to implement these and still further objects of the invention, which will become more readily apparent as the description proceeds, the toothbrush of the present development is manifested by the features that, the date-indicating arrangement is provided with a second markings cooperating with the first marker, and an indicator or display element rotatably mounted at the bristle support or carrier. This indicator or indicating element can be provided with one of both markings or indicia, and can be set upon rotating the indicator element to the other marker provided at the bristle support or carrier.

Upon beginning to use the toothbrush the user is able to align or cooperatively correlate both of the markings or indicia with respect to one another by simply rotating the indicator element connected with the bristle carrier or support, in order to thereby achieve an accurate indication of the date of first use and/or the point in time of required or desired replacement of the toothbrush. To apply the date indication there is not required any separate instrument. The user can readily determine at any point in time, by simply looking at the toothbrush, when he or she began using such toothbrush and when it is necessary to replace the same.

In contrast to spoilable foodstuffs or products and pharmaceuticals or the like, where the point in time after which such articles no longer should be used begins to run from the moment of fabrication, packaging and sale, in the case of a toothbrush the dates of manufacture, packaging or sale are of no moment, rather what is important is the point in time or date when the toothbrush is first used. Also in contrast to the aforementioned spoilable foodstuffs and pharmaceutical products, where the dating of these articles can be accomplished during the course of their manufacture or packaging, the dating of the toothbrush must be accomplished by the user following purchase of such toothbrush. These requirements are effectively fulfilled in a most simple and advantageous manner in accordance with the teachings of the invention.

BRIEF DESCRIPTION OF THE DRAWINGS

The invention will be better understood and objects other than those set forth above, will become apparent when consideration is given to the following detailed description thereof. Such description makes reference to the annexed drawings.

DETAILED DESCRIPTION OF THE PREFERRED EMBODIMENTS

Figure 1:
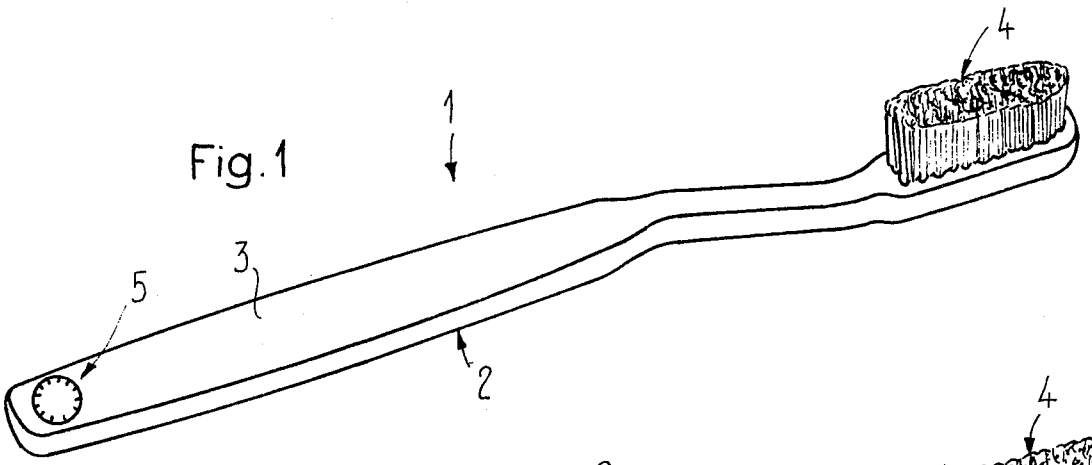
FIGS. 1 and 2 illustrate two different constructions of toothbrushes according to the invention provided with associated dating or date-indicating arrangements or facilities.
Figure 2:
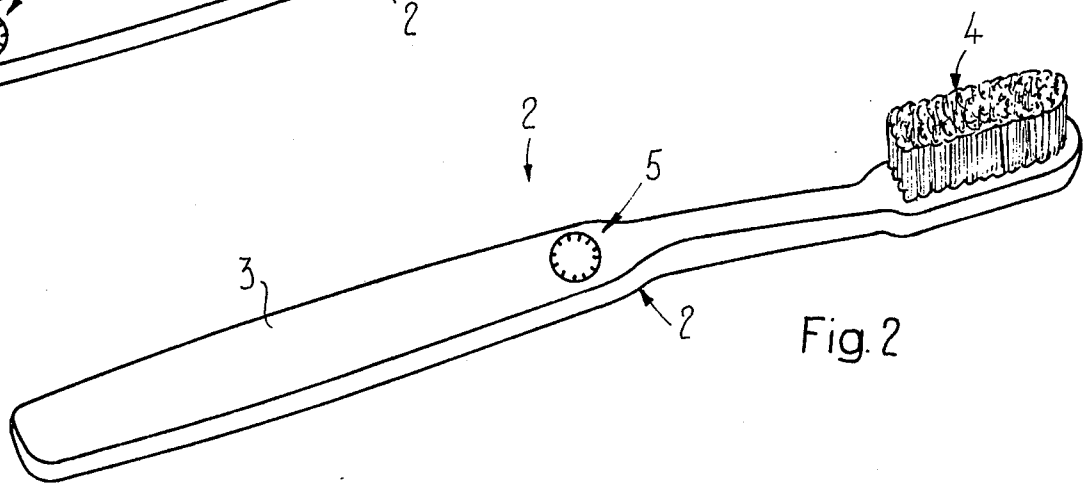

Describing now the drawings, in FIGS. 1 and 2 there have been respectively illustrated in perspective view two different constructions of a toothbrush 1 constructed according to the invention, each containing a bristle support or carrier 2 extending between opposed ends of such toothbrush. The rear end of each such bristle support or carrier 2 serves, in known manner, as the handle or handgrip 3, whereas at the front end of each such bristle support or carrier 2 there are mounted the brush bristles 4. These toothbrushes 1 are also provided with an only schematically illustrated dating or date-indicating arrangement 5 which will be, however, more fully described hereinafter in conjunction with FIGS. 3 to 11 inclusive. With the embodiment of FIG. 1, this dating or date-indicating arrangement 5 is located at the rear end of the toothbrush handle 3, whereas with the modified construction of toothbrush 1 shown in FIG. 2 the dating or date-indicating arrangement 5 is provided at the front region of such handle or handgrip 3, i.e. at the intermediate region of the bristle support or carrier 2.

Figure 4:
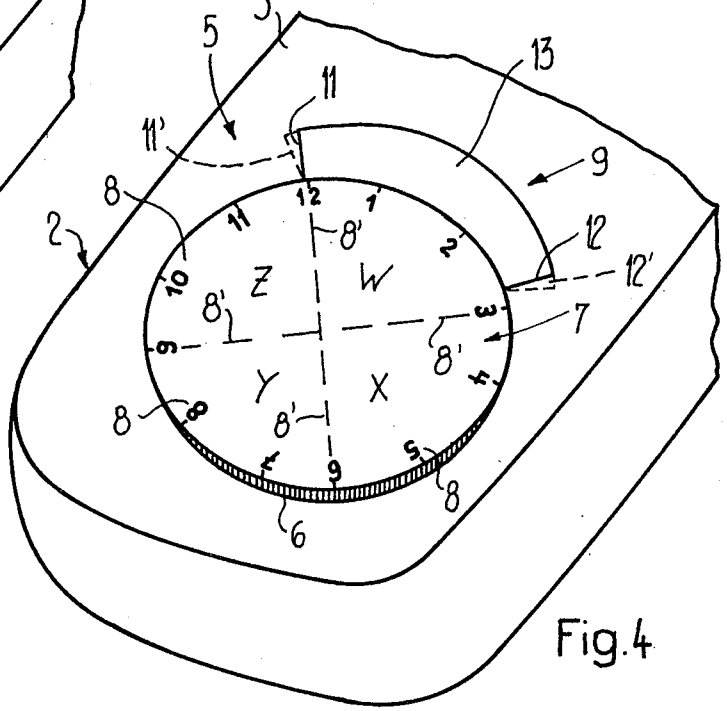
FIGS. 3 to 9 respectively show, and on an enlarged scale in relation to FIGS. 1 and 2, the end region of a toothbrush handle or handgrip provided with different constructions of dating or date-indicating arrangements according to the invention.
Figure 3:
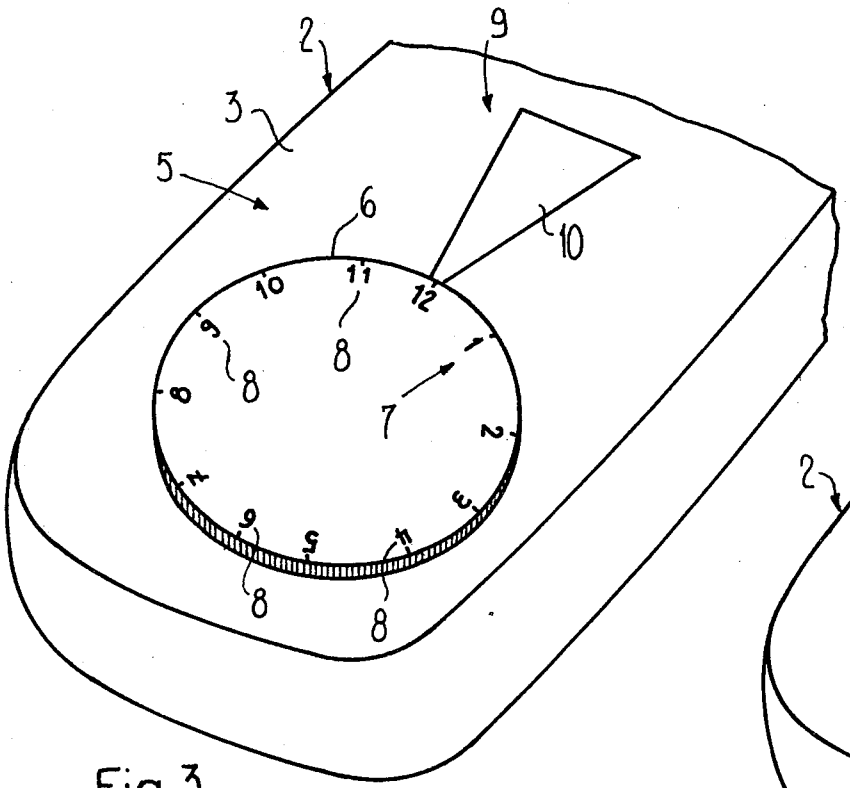

As best seen by referring to FIGS. 3 and 4, where there have been depicted similar constructions of certain details of the toothbrush, the dating or date-indicating arrangement 5 contains a substantially disk-shaped indicator or display element 6 which, viewed in top plan view, possesses an essentially circular configuration. This indicator element 6 is rotatably mounted in the toothbrush handle 3 in a manner to be discussed in greater detail hereinafter. This indicator element 6 is provided with marking means or indicia, generally indicated by reference character 7, these marking means being here constructed in the form of a scale. The marking means or markings 7 comprise a number of partial symbols or appropriate characters or data 8 which are distributed in at an essentially equidistant spacing from one another along the circular circumference of the indicator or display element 6. By means of such partial symbols or individual markings or characters 8 the circumference of the disk-shaped indicator element 6 is subdivided into twelve regions or sections, each of which designates a given month of the year. In the embodiments under discussion, the partial symbols or characters 8 represent the numbers 1 to 12 characteristic of the individual time intervals, meaning the months of the year, represented by such partial symbols 8. It should be understood that instead of numbers there also could be used any other suitable symbols or characters enabling ready differentiation of the individual months from one another. Thus, for instance, it is also possible to configure the markings or marking means 8 similar to the face or dial of a watch, in other words, such may be constituted by suitable partial lines or the like. A stationary marker 9, in the form of a pointer in the arrangement of FIG. 3 and a curved bar-like element in the arrangement of FIG. 4, is arranged at the toothbrush handle 3 opposite the markings or indicia 7, this marker 9 coacting with the other markings or marking means 7. In the exemplary embodiment depicted in FIG. 3, the marking or pointer 9 is formed by a single mark 10 having the shape of a triangle. With the modified arrangement of FIG. 4, the marker 9 is constructed as two spaced markers or indicia 11 and 12 in the form of short lines which are arranged in spaced relationship from one another and defining therebetween the aforementioned curved bar-like element. As shown in broken lines in FIG. 4, the markers 11 and 12 also could be constructed in the form of substantially triangular-shaped markers 11' and 12'. The spacing between the markers 11 and 12 or 11' and 12', as the case may be essentially corresponds to three-times the spacing between the neighboring partial symbols or individual characters 8 of the markings or marking means 7. The curved bar-like region 13 which is located between the markers 11, 12 or 11', 12', respectively, can be appropriately optically accentuated, for instance by suitable coloring the same.

By rotating the rotatable indicator or display element 6 the coacting markings or marking means 7 and 9 can be appropriately set with respect to one another, in order to thus obtain an indication or display of the date that the toothbrush 1 was first put into use or the point in time that such toothbrush 1 should be replaced. With the exemplary embodiment of toothbrush 1 depicted in FIG. 3, there is aligned either the partial or individual symbol or character 8 indicating the month when the toothbrush was first used or the month when the toothbrush should be replaced with the pointer-like marker 10. Thereafter, the indicator element 6 is arrested in its set position. The individual or partial symbol 8 located opposite the marking 10 then indicates the time when the toothbrush 1 was initially used or when replacement thereof is desired or required.

With the embodiment of FIG. 4, the individual or partial symbol or character 8 representative of the point in time when the toothbrush was first used is brought into coincidence or alignment with the marker 11 or 11', as the case may be. The other marking or marker 12 or 12' then indicates at the marking means 7 the month when the toothbrush should be replaced. According to the illustration of FIG. 4, it will be evident that the toothbrush was first used in the month of December and therefore must be replaced the following March. The variant embodiment of toothbrush depicted in FIG. 4 has the advantage, in contrast to the toothbrush construction of FIG. 3, that there can be simultaneously displayed or indicated both the date of the initial use and also the point in time of the intended replacement of the toothbrush.

It is not absolutely required to indicate each month by a partial or individual symbol or character 8. As has been shown in broken lines in FIG. 4, there can be provided only four partial or individual symbols 8' in the form of lines or broken lines which are spaced from one another through a sector angle of 90°. By means of two neighboring lines 8' there is defined a time interval corresponding to one-quarter of the year. The sectors of the indicator element 6, correlated to the individual quarters of the year, can be designated by a suitable symbol, as such has been indicated by the reference characters W, X, Y and Z. Thus, for instance, the sector designated by the letter W represents the winter season, the sector X the spring season, the sector Y the summer season, and the sector Z the fall season of each corresponding quarter of the year.

Figure 6:
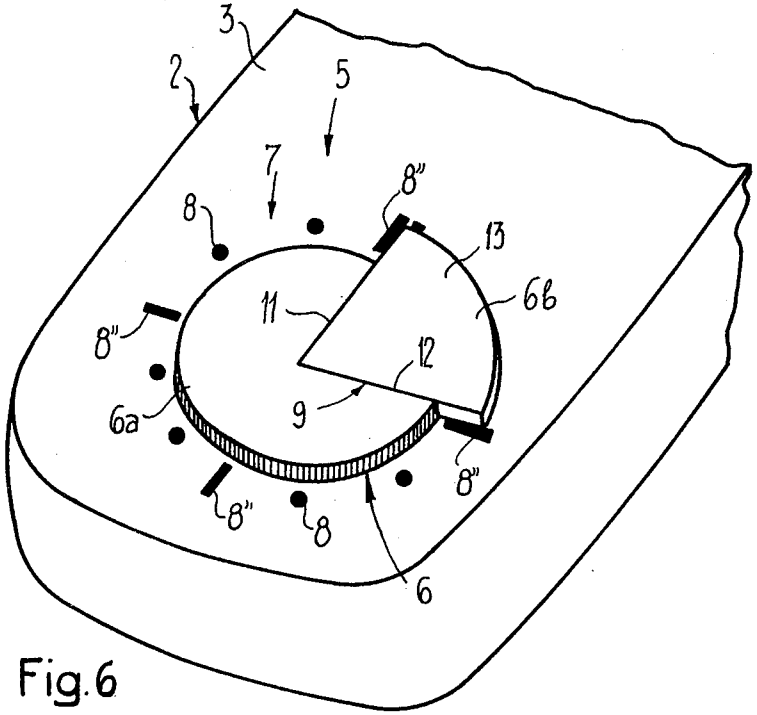
Figure 5:
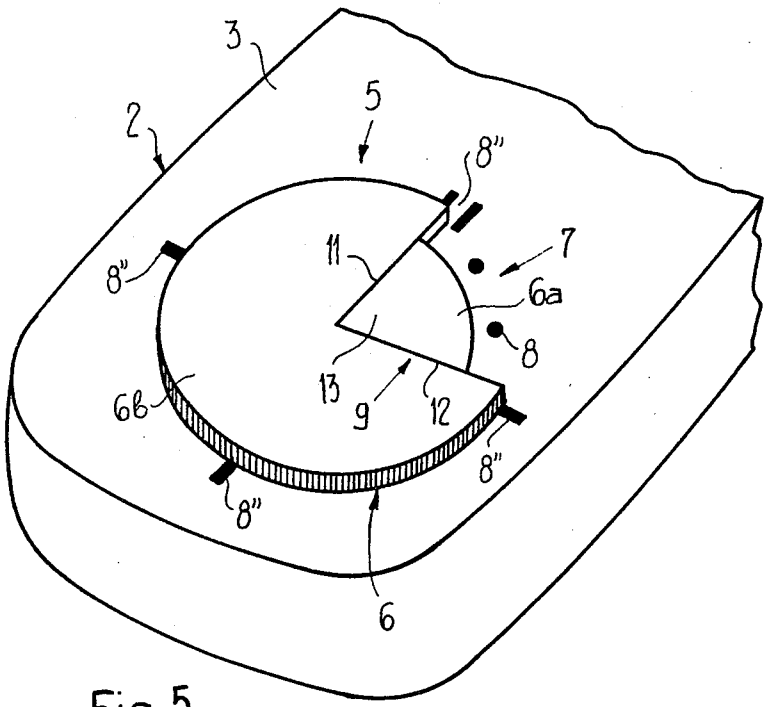

It should be understood that the markings or the markers 7 and 9 also can be interchanged, as such has been illustrated for the modifications of toothbrush depicted in FIGS. 5 and 6. The markings or marking means 7 constructed similar to the dial or face of a watch are mounted at the toothbrush handle 3, and the individual or partial symbols 8 are uniformly distributably arranged along a circular line or arc. The partial or individual symbols 8" representative of the months December, March, June and September, are in the form of short lines, whereas the remaining partial or individual symbols 8 are in the form of dots or points.

The indicator element 6 rotatably and arrestably mounted in the toothbrush handle 3 comprises a substantially disk-shaped lower portion 6a, the base portion, and an upper portion 6b which is constructed as a sector of a circle having a sector angle of 270° (FIG. 5) or 90° (FIG. 6). The edges bounding the sectors of the circle form the marks or indicia 11 and 12 of the marker 9. By means of the sector 13 located between these marks 11 and 12 there is indicated the duration of use of the toothbrush.

The upper portion 6b protrudes past the lower portion 6a and completely covers a portion of the point-like partial or individual symbols 8, whereas the graduation or division lines 8" located beneath the upper portion 6b are only partially covered.

The setting of the indicator element 6 is accomplished in the manner previously described in conjunction with the embodiment of FIG. 4.

The depicted design of the indicator or display element 6 enables constructing the same, without any great difficulties, dual-colored, for instance by means of injecting molding techniques conventionally used in the plastics art. An indicator element 6 constructed to possess two colors imparts a particular esthetic appearance to the toothbrush.

Figure 7:
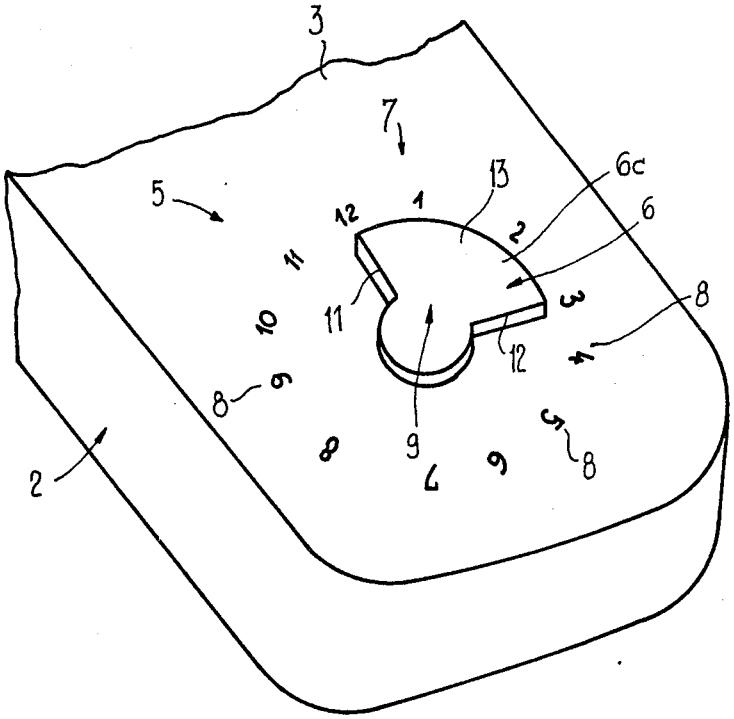

A further variant construction of the dating or date-indicating arrangement 5 has been illustrated in FIG. 7. The marking means or markings 7 are likewise applied to the toothbrush handle 3, for instance by being embossed thereon. The individual or partial symbols or characters 8, constituted by numbers, are equidistantly distributively arranged along a circular line. The rotatably and arrestable indicator element 6 possesses a portion 6c in the form of a circular sector having a sector angle of 90°. However, the indicator element 6 also can be constructed in its entirety as a circular sector. The boundary edges of the circular sector 6c form the marks 11 and 12 of the marking means 9. The radius of the indicator element 6 is smaller than the radius of the circle at which lie the partial or individual symbols 8 of the marking means or markings 7, so that the latter always remain visible. Under circumstances, it is possible for the circular sector 6c to be designed to be descendingly tapered or bevelled towards its circumference.

The embodiment of FIG. 7 has the advantage, in relation to the quite similar embodiment of FIG. 6, that the manufacture of the indicator or display element 6 is simpler and less expensive, and that the marking means or markings 7 at the handle 3 are never covered.

Figures 8, 9:
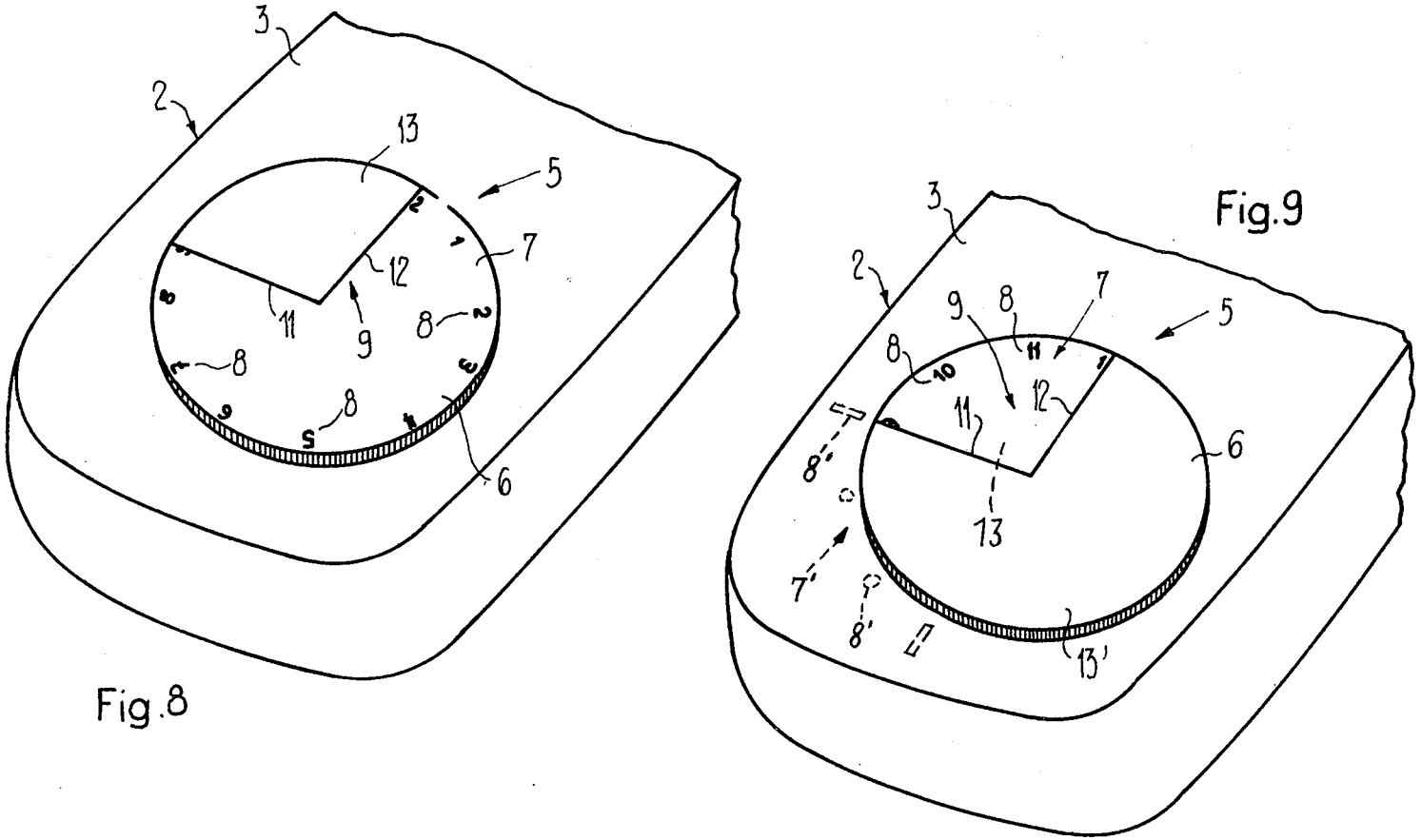

With the exemplary embodiment depicted in FIGS. 8 and 9, the marking means 7 likewise are applied to the toothbrush handle 3, and specifically, beneath the disk-shaped rotatable indicator element 6. In order to render visibly discernible the partial or individual symbols or characters 8 of the marking means 7, the indicator element 6 advantageously is of transparent construction. Applied to the indicator element 6 are the markers 11 and 12 of the marking means or markings 9. In order to enchance the readability it is possible for the sector 13 located between the markings 11 and 12 and having a sector angle of 90° (FIG. 8), or the sector 13' having a sector angle of 270° (FIG. 9), to be constructed to be opaque or less transparent, for instance by appropriately coloring the same, than the remaining region of the indicator element 6.

Instead of designing the indicator element 6 so as to be transparent or non-transparent or opaque in sectors, it is also possible to design only the circular-shaped marginal region or portion of the indicator element 6 located above the partial or individual symbols 8 of the marking means 7 so as to be transparent or non-transparent, as the case may be.

Just as was the case for the embodiment of FIG. 7, the markings 7' also can be applied to the toothbrush handle or handgrip 3 in such a fashion that their partial or individual symbols 8' are not covered by the indicator element 6, as such has been shown in broken lines in FIG. 9. Instead of using numbers there can be used for the partial or individual symbols 8' also points or dots and/or lines, similar to the exemplary embodiments previously discussed in conjunction with FIGS. 5 and 6. The indicator element 6 need not be designed to be transparent. To facilitate the reading thereof it is sufficient to construct the sectors 13 and 13' which are separated from one another by the markers 11 and 12 so as to be of different colors.

Furthermore, it is also conceivable to design the indicator element 6, instead of in the form of a disk or circular plate, like or similar to the parts 6b and 6c of the embodiment according to FIGS. 5, 6 and 7, in the form of circular sectors having a sector angle of 90° or 270°, respectively. The markers 11 and 12 of the marking means or markings 9, in this case, likewise are constituted by the edges bounding these sectors of a circle.

Furthermore, the marking means 7 also can be applied to the transparent indicator or display element 6. The markers or indicia 11 and 12 of the marker 9 applied to the toothbrush handle or handgrip 3 and located beneath the indicator element 6 are then constructed such that they are visible through the indicator element 6. The sector 13 or 13', respectively, located between such markers 11 and 12 can likewise be accentuated by using suitable coloring.

Based upon the illustration of FIGS. 10 and 11 there now will be explained the following possibilities for attachment of the indicator or display element 6 at the bristle support or carrier 2.

Figure 10:
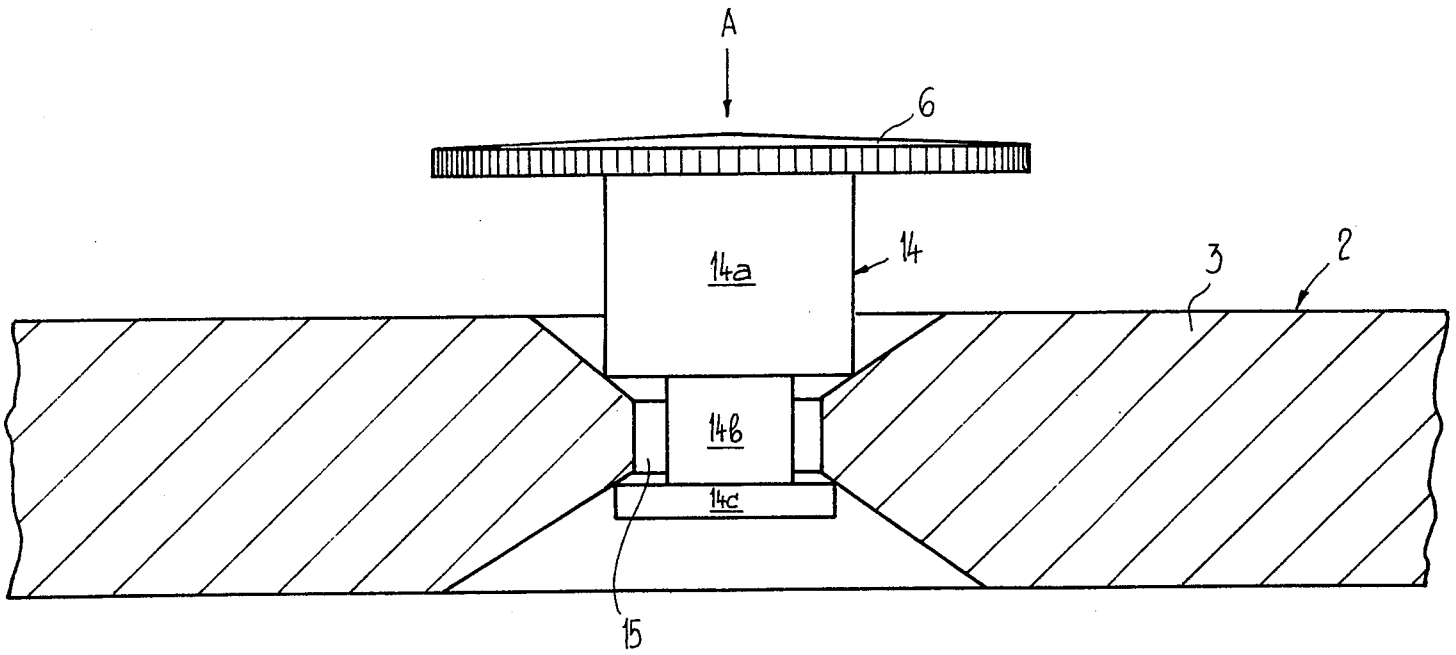
FIG. 10 is a longitudinal sectional view, again on an enlarged scale, through the region of the toothbrush handle equipped with one of the dating or date-indicating arrangements of the invention.

With the variant embodiment of FIG. 10 the substantially disk-shaped indicator element 6 is seated upon a shaft 14 which piercingly extends through an opening or hole 15 in the handgrip 3. This opening or hole 15 is already present at the end of the handgrip 3 for a great many standard toothbrushes presently in use. The stepped shaft 14 possesses three shaft portions or sections 14a, 14b and 14c, wherein the shaft portions 14a and 14c possess a diameter which is greater than the diameter of the circular-shaped opening 15. On the other hand, the intermediate shaft portion or section 14b is smaller in diameter than the opening 15. In the position depicted in FIG. 10, where the shaft portion 14b piercingly extends through the opening 15, the indicator element 6 is indeed retained in the bristle support or carrier 2, however can be rotated. However, after accomplishing the setting of the markings 7 and 9 the indicator element 6 can be arrested in its desired or set position by exerting a pressure in the direction of its axis of rotation, i.e., in the direction of the arrow A. If, as mentioned pressure is exerted upon the indicator element 6, then the shaft portion 14a, while elastically deforming the same, is pressed into the opening 15, with the result that the indicator element 6 is secured against any unintentional rotation.

Figure 11:
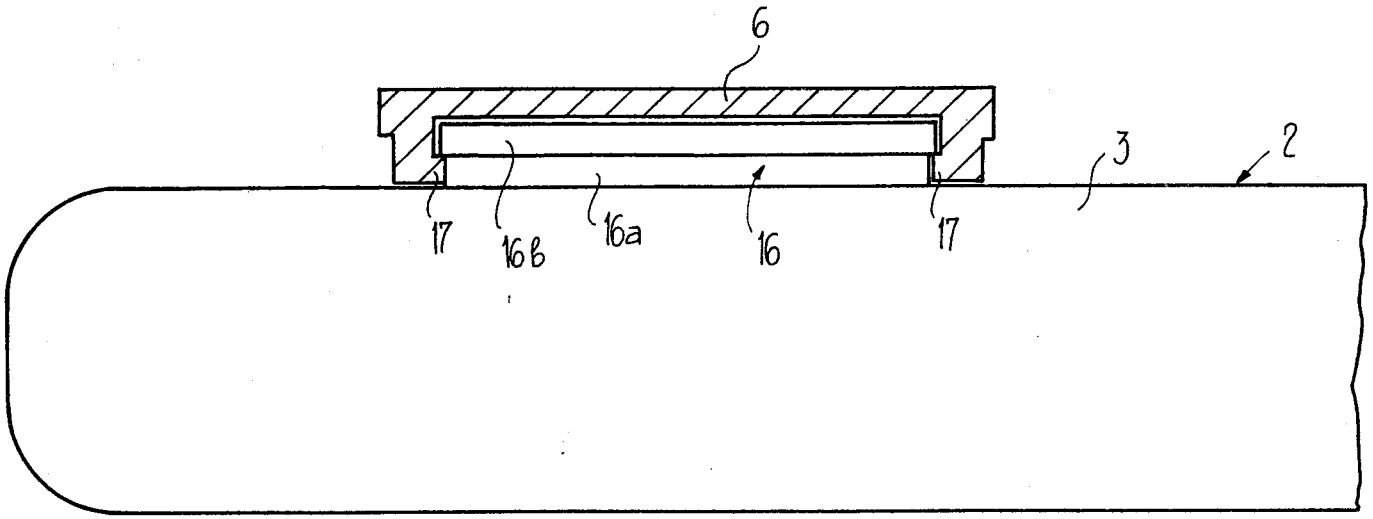
FIG. 11 is a side view, partially in section, of an end of the toothbrush handle equipped with the dating or date-indicating arrangement.

With the embodiment depicted in FIG. 11, the indicator or display element 6 is mounted upon a bearing pin or journal 16 which is formed at the upper side or face of the bristle support or carrier 2. The lower portion 16*a* of this bearing pin 16 possesses a smaller diameter than the upper bearing pin portion 16*b*. The indicator element 16 engages beneath the upper bearing pin portion 16*b* by means of its lower edge 17 which protrudes inwardly, and thus, is rotatably retained thereat. The arresting of the indicator element 6 is accomplished in not here further illustrated fashion after completion of the setting of the markings 7 and 9.

The manner of attaching the indicator element 6 according to the embodiment of FIG. 11 has the advantage that no throughpass opening need be provided in the bristle support or carrier 2. Thus, the dating or date-indicating arrangement 5 can be arranged at the front end of the toothbrush handle 3, as the same has been illustrated in FIG. 2. The embodiment of FIG. 11 is particularly suitable, although not exclusively, for use in the exemplary embodiments depicted in FIGS. 8 and 9, whereas the attachment technique depicted in FIG. 10 is particularly advantageous for use with the variant constructions of toothbrushes depicted in FIGS. 5, 6 and 7.

Instead of designing the indicator or display element 6, as illustrated, to be substantially circular in configuration in top plan view, it is also possible to impart to such indicator element 6 a different shape. Thus, for instance, such indicator element 6, viewed in top plan view, can possess, for instance another radial-symmetrical form, especially the shape of an equal-sided polygon, for instance a dodecahedron.

During the herein given description of the exemplary embodiments there was assumed that a toothbrush should not be used for a longer period of time than three months. In the event that such time span, which has been found to be a useful period of use for toothbrushes at the present time, should change in the future, then it should be apparent that the spacing of both markers 11 and 12 of the marker or marking means 10 must be correspondingly altered.

All of the illustrated exemplary embodiments enable the users to undertake in a most simple manner, dating of their toothbrush, and allows them to ascertain at any point in time, without any great effort, the amount of time which has elapsed since he or she first began using the toothbrush and when replacement thereof is needed. The illustrated solutions are simple in their construction and also can be fabricated quite inexpensively.

While there are shown and described present preferred embodiments of the invention, it is to be distinctly understood that the invention is not limited thereto, but may be otherwise variously embodied and practiced within the scope of the following claims. Accordingly,

What I claim is:

1. A toothbrush comprising:

a bristle support containing bristles;

a date-indicating arrangement possessing first marking means;

said first marking means indicating a number of mutually different time intervals;

said date-indicating arrangement possessing second marking means;

said date-indicating arrangement further including an indicator element rotatably mounted at said bristle support;

said indicator element being provided with one of both of said marking means;

the other of said marking means being provided at said bristle support; and said one marking means being settable in relation to the other marking means provided at said bristle support upon rotation of said indicator element.

2. The toothbrush as defined in claim 1, wherein:

said first marking means is structured to indicate a number of mutually different but essentially equal length time intervals.

3. The toothbrush as defined in claim 1, further including:

means for positionally arresting said indicator element.

4. The toothbrush as defined in claim 1, wherein:

said second marking means contains at least one marker.

5. The toothbrush as defined in claim 3, wherein:

said second marking means contains at least one marker.

6. The toothbrush as defined in claim 4, wherein:

said second marking means comprises two markers arranged in spaced relationship from one another.

7. The toothbrush as defined in claim 6, further including:

means rendering visible at least a portion of a region of the second marking means disposed between both of said two markers thereof.

8. The toothbrush as defined in claim 7, wherein:

said visible rendering means comprises imparting coloring to said region.

9. The toothbrush as defined in claim 1, wherein:

said indicator element possesses a substantially radial symmetrical configuration.

10. The toothbrush as defined in claim 9, wherein:

said indicator element possesses a substantially circular configuration in plan view.

11. The toothbrush as defined in claim 1, wherein:

said indicator element is constructed as a sector of a circle.

12. The toothbrush as defined in claim 1, wherein:

said indicator element is constructed as a circular sector-shaped portion.

13. The toothbrush as defined in claim 1, wherein:

said first marking means contains partial symbols delimiting time intervals.

14. The toothbrush as defined in claim 13, wherein:

said partial symbols are arranged at an essentially equidistant spacing from one another.

15. The toothbrush as defined in claim 13, wherein:

said partial symbols are distributively arranged along a circular-shaped line.

16. The toothbrush as defined in claim 13, wherein:

said partial symbols are arranged at the circumference of the indicator element.

17. The toothbrush as defined in claim 13, wherein:

said partial symbols are arranged neighboring the circumference of the indicator element at the bristle support.

18. The toothbrush as defined in claim 15, wherein:

said partial symbols are arranged at the circumference of the indicator element.

19. The toothbrush as defined in claim 15, wherein:

said partial symbols are arranged neighboring the circumference of the indicator element at the bristle support.

20. The toothbrush as defined in claim 13, wherein:

said partial symbols are arranged neighboring the circumference of the indicator element at the bristle support;

said second marking means comprises two markers arranged in spaced relationship from one another; and the spacing between the markers of the second marking means amounting to at least spacing between neighboring partial symbols.

21. The toothbrush as defined in claim 13, wherein:

said partial symbols are arranged neighboring the circumference of the indicator element at the bristle support;

said second marking means comprises two markers arranged in spaced relationship from one another; and the spacing between the markers of the second marking means amounting to at least a multiple of the spacing between neighboring partial symbols.

22. The toothbrush as defined in claim 17, wherein:

said indicator element possesses a substantially disk-shaped configuration; and the individual partial symbols arranged at the bristle support are at most partially covered.

23. The toothbrush as defined in claim 19, wherein:

said indicator element possesses a substantially disk-shaped configuration; and the individual partial symbols arranged at the bristle support are at most partially covered.

24. The toothbrush as defined in claim 17, wherein:

the indicator element possesses a substantially disk-shaped configuration;

the partial symbols arranged at the bristle support are covered; and at least a portion of the indicator element is transparent.

25. The toothbrush as defined in claim 19, wherein:

the indicator element possesses a substantially disk-shaped configuration;

the partial symbols arranged at the bristle support are covered; and at least a portion of the indicator element is transparent.

26. The toothbrush as defined in claim 6, wherein:

the first marking means contain partial symbols delimiting the time intervals;

said partial symbols being arranged neighboring to the circumference of the indicator element at the bristle supports; and a region of the indicator element which is located between both markers optically differentiating from the remaining portion of the indicator element.

27. The toothbrush as defined in claim 2, wherein:

said indicator element comprises a shaft rotatably mounted in the bristle support; and said shaft being arrestable in the bristle support by applying a force in its axial direction.

28. The toothbrush as defined in claim 2, further icluding:

bearing pin means arranged at the bristle support;

said indicator element being rotatably and arrestably mounted upon said bearing pin means; and said bearing pin means laterally engaging beneath the indicator element.

29. A toothbrush comprising:

a bristle support containing bristles;

a date-indicating arrangement possessing first and second marking means;

said first marking means indicating a number of mutually different time intervals;

said second marking means comprising two markers arranged in fixed spaced relationship to one another;

said date-indicating arrangement further including an indicator element rotatably mounted at said bristle support;

said indicator element being provided with one of both of said marking means;

the other of said marking means being provided at said bristle support; and said one marking means being settable in relation to the other marking means provided at said bristle support upon rotation of said indicator element.

30. The toothbrush as defined in claim 29, wherein:

said first marking means indicating a number of time intervals which are substantially integral multiples of a basic time interval.

31. The toothbrush as defined in claim 29, wherein:

said fixed spaced relationship corresponding to a prescribed portion of said time intervals.

32. The toothbrush as defined in claim 31, wherein:

said prescribed portion indicating a final time in relation to an initial time.

33. The toothbrush defined in claim 29, wherein:

said first marking means containing partial symbols delimiting said time intervals;

said partial symbols being arranged neighboring to the circumference of said indicator element at said bristle supports; and a region of the indicator element which is located between both of said two markers optically differentiating from the remaining portion of the indicator element.

34. The toothbrush as defined in claim 33, wherein:

said fixed spaced relationship corresponding to a prescribed portion of said time intervals; and said prescribed portion corresponding to at least the spacing between neighboring ones of said partial symbols.

35. The toothbrush as defined in claim 33, wherein:

said fixed spaced relationship corresponding to a prescribed portion of said time intervals; and said prescribed portion corresponding to at least a multiple of the spacing between neighboring ones of said partial symbols.

36. The toothbrush as defined in claim 29, wherein:

said indicator element comprises a shaft rotatably mounted in said bristle support; and said shaft being arrestable in the bristle support by applying a force in an axial direction thereof.

* * * * *